US005459920A

United States Patent [19]

Huang

[11] Patent Number: 5,459,920

[45] Date of Patent: Oct. 24, 1995

[54] METHOD OF MAKING ARTIFICIAL FLOWERS

[76] Inventor: William Huang, 3-2F., No. 127, Shui Yuan Road, Taipei, Taiwan

[21] Appl. No.: 268,962

[22] Filed: Jun. 30, 1994

[51] Int. Cl.[6] ..... B23P 25/00

[52] U.S. Cl. ..... 29/458; 29/469; 428/24; 156/61

[58] Field of Search ..... 29/458, 469, 527.2, 29/527.4; 428/24, 26, 905; 427/4; 156/61

[56] References Cited

U.S. PATENT DOCUMENTS

| | | | |
|---|---|---|---|
| 1,831,559 | 11/1931 | Ham et al. | 428/26 |
| 1,886,429 | 11/1932 | Saeks | 428/26 |
| 4,324,821 | 4/1982 | Heineman, III | 428/24 |
| 4,957,787 | 9/1990 | Reinhardt et al. | 428/24 |

FOREIGN PATENT DOCUMENTS

| | | | |
|---|---|---|---|
| 2365969 | 6/1978 | France | 428/24 |
| 20194 | 10/1892 | United Kingdom | 428/24 |

*Primary Examiner*—David P. Bryant
*Attorney, Agent, or Firm*—Varndell Legal Group

[57] ABSTRACT

A method of making an artificial flower by fastening an artificial flower to a processed genuine flower stem by a bonding agent. The artificial flower is obtained by I) selecting the core of the stem of a woody plant as a base material and then using a plane to plane the base material into plain strips according to a predetermined width, length and thickness; II) putting the plain strips into a punching die and then punching them into patterned strips; III) dipping the patterned strips in an aromatic solution at room temperature for 35 to 45 minutes; IV) putting the patterned strips thus obtained from step III) into a dye bath and dying the patterned-colored strips; V) putting the patterned-colored strips into a form setting solution heated to 80° C. and then setting the patterned-color strips into desired shapes; VI) drying the shape-formed strips thus obtained from step V); VII) cooling down the shape-formed strips thus obtained from step VI) in a refrigerator at 7° C. to for 3 hours so that artificial petals are obtained; and VIII) fastening the artificial petals to a metal wire to form an artificial flower.

3 Claims, 4 Drawing Sheets

METHOD OF MAKING ARTIFICIAL FLOWERS

BACKGROUND AND SUMMARY OF THE INVENTION

The present invention relates to a method of making artificial flowers, and more particularly to the method of making an artificial flower by processing the core of the stem of a woody plant (the herbage of wood fiber), which is generally white into artificial petals and fastening the artificial petals to a metal wire to form an artificial flower and then fastening the artificial flower to a processed genuine flower stem by a bonding agent.

Artificial flowers have been intensively accepted for indoor as well as outdoor decorations for the advantage of long service life. Regular artificial flowers are made similar to genuine flowers in shape, however they do not smell sweet. Furthermore, a genuine flower withers quickly when it is removed from the earth or the flower bed. When a genuine flower withers, it can only the thrown away.

The present invention has been accomplished in view of the aforesaid circumstances. It is one object of the present invention to produce an artificial flower which smells sweet. It is another object of the present invention to provide a method of making artificial flowers which uses waste natural twigs and flower stems for making the stems for artificial flowers.

DETAILED DESCRIPTION OF THE PREFERRED EMBODIMENT

Figure 5:
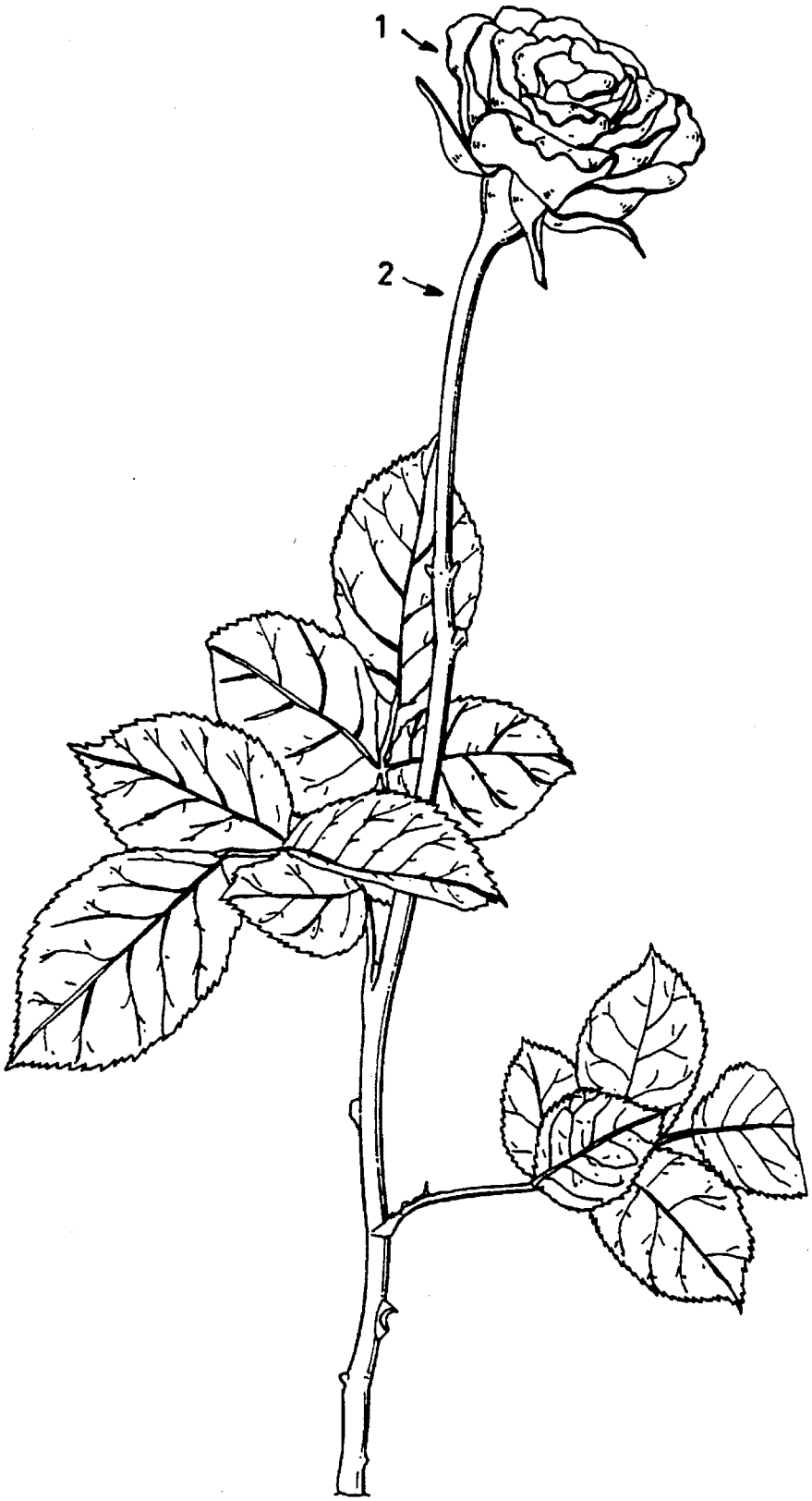
FIG. 5 is an elevational view of an artificial flower made according to the present invention.

Referring to FIG. 5, the present invention is to fasten an artificial flower 1 to a stem 2.

Figure 1:
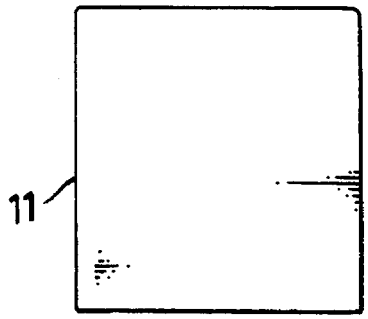
FIG. 1 shows a plain strip obtained from the white core of the stem of the herbage of wood fiber.
Figure 2:
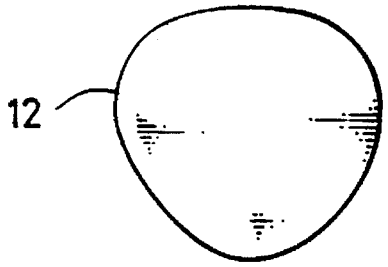
FIG. 2 shows the strip of FIG. 1 punched into a patterned strip.
Figure 3:
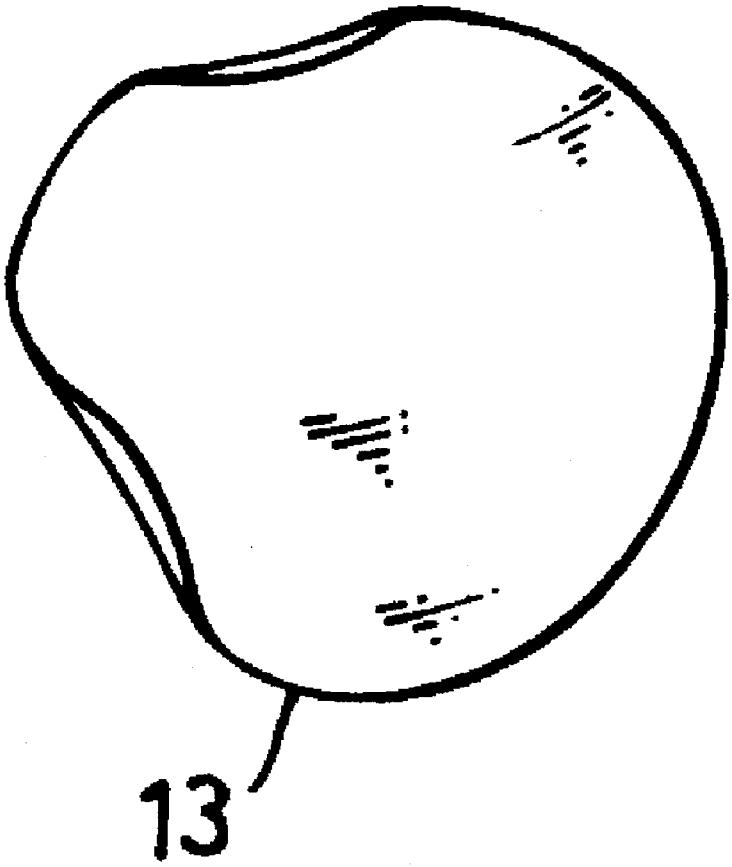
FIG. 3 shows the patterned strip of FIG. 2 processed into an artificial petal.
Figure 4:
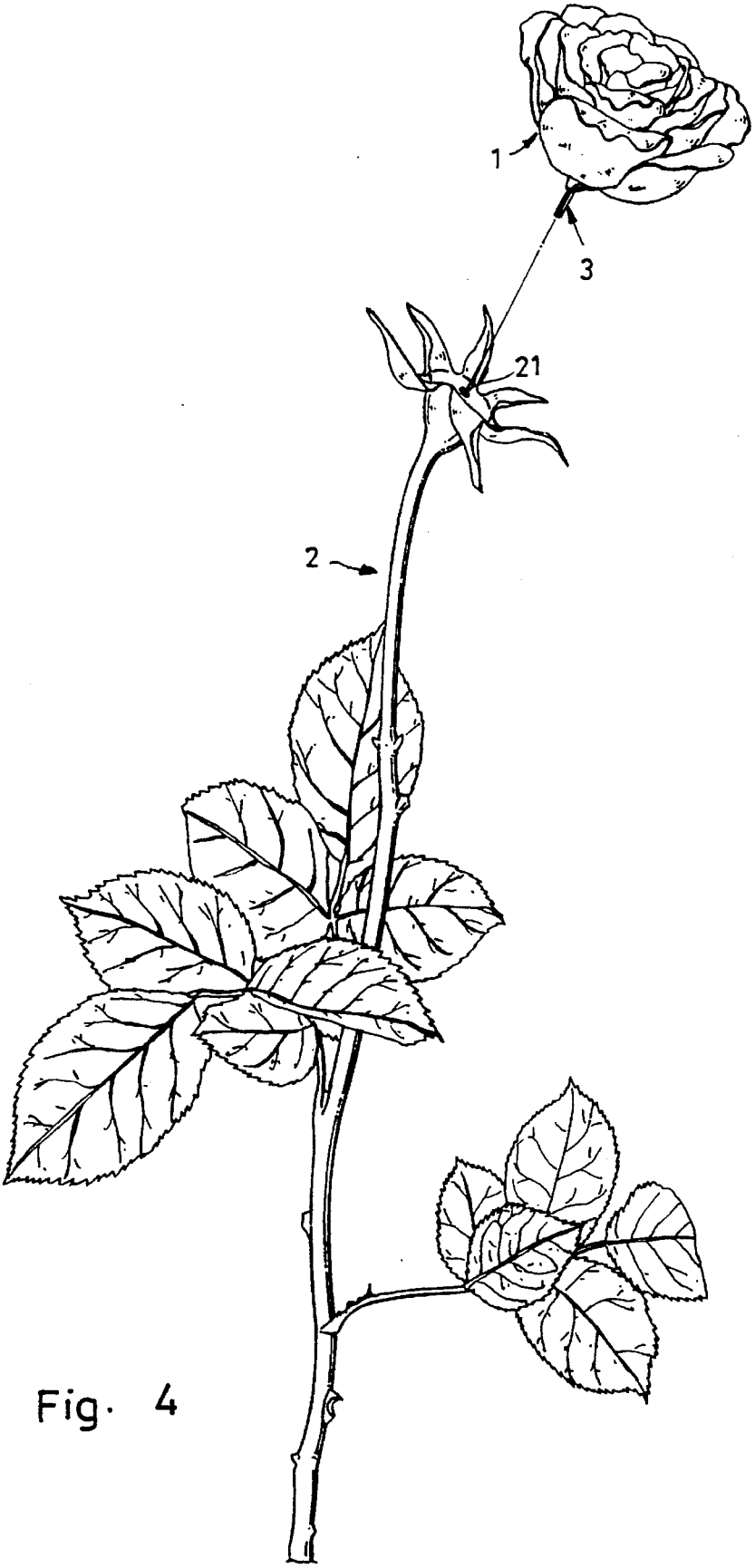
FIG. 4 is a dismantled view of an artificial flower made according to the present invention.

The artificial flower 1 is prepared according to the procedure outlined hereinafter. The core of the stem of a woody plant (the herbage of wood fiber), which is generally white, is selected as a base material and then a plane is used to plane the base material into plain strips 11 (see FIG. 1) according to a predetermined size (the width, length and thickness of the plain strips 11 are subject to the kind of the flower to be made). The plain strips 11 are put into a punching die and then punched into patterned strips 12 (see FIG. 2) having curves on the surface like genuine petals. The patterned strips 12 are then dipped in an aromatic solution at room temperature and maintained therein for 35 to 45 minutes. When removed from the aromatic solution, the patterned strips 12 are fragrant and have a suitable water content. The patterned strips 12 thus obtained are then put into a dye bath and properly dyed with the desired color. After the process of dying, the colored strips are then put into a form setting solution that is heated to 80° C. and immediately taken out of the form setting solution, and then the patterned strips 12 are set into shape-formed strips (artificial petals) 13. The shape-formed strips (artificial petals) 13 thus obtained are then dried in a dryer at 40° C. to 45° C. for 35 to 40 minutes. After drying, the shape-formed strips (artificial petals) 13 are put in a refrigerator and maintained at 7° C. to 8° C. for 3 hours. After cooling, curved-artificial petals 13 are finished (see FIG. 3). The curved-artificial petals 13 are then fastened to a metal wire 3 by a bonding agent for forming the artificial flower 1 (see FIG. 4). The artificial flower 1 thus obtained is then fastened to the stem 2. The process of fastening the artificial petals 13 to the metal wire 3 can be accomplished by manual labor or a specially designed machine.

The stem 2 is made by dipping a genuine flower stem into a solution containing lanolin 2%, polyvinyl acetate 6% and water 92% for approximately an hour. A metal wire (not shown) is inserted into the stem, and then the stem is dried in a dryer at 80° C. to 85° C. for 50 to 60 minutes to remove about 70% of the water content. After drying, the metal wire is removed from the stem, and then the top end of the stem is processed into a receptacle 21 for receiving an artificial flower 1 made according to the aforesaid procedure.

Referring to FIG. 5, the metal wire 3 of the artificial flower 1 is coated with a layer of bonding agent such as polyvinyl acetate, and then inserted into the receptacle 21 at one end of the stem 2.

The aforesaid aromatic solution contains by volume:

Sodium α-methyl-α alkylester sulfate: 1.6% to 2.1%

Sodium alkyl aryl sulfate: 2% to 2.3%

Lanolin: 1.1% to 1.75%

Essence: 0.8%

Glycerin: 1.7% to 2.8% and

Water: 90.25% to 93.3%

The aforesaid form setting solution contains by volume:

Polyvinyl acetate: 3% to 6%

Acetic acid: 5% to 12% and

Water: 82% to 92%.

I claim:

1. A method for making an artificial flower comprising:

preparing an artificial flower by selecting a core of a stem of a woody plant as a base material, planing the base material with a plane into plain strips having a predetermined width, length and thickness; punching the plain strips into patterned strips in a punching die; dipping the patterned strips in an aromatic solution at room temperature for 35 to 45 minutes; dying resulting aromatic patterned strips into patterned-colored strips by placing the aromatic patterned strips into a dye bath; putting the patterned-colored strips into a form setting solution heated to 80° C. and setting the patterned-colored strips into desired shapes; drying resulting shape-formed strips in a dryer at 40° C. to 45° C. for 35 to 40 minutes; cooling the shape-formed strips in a refrigerator at 7° C. to 8° C. for 3 hours so that artificial petals are obtained; and fastening the artificial petals to a first metal wire to form the artificial flower;

preparing a flower stem by dipping a genuine flower stem into a solution containing lanolin 2%, polyvinyl acetate 6% and water 92% for approximately an hour; inserting a second metal wire into the stem; drying the stem containing the second metal wire in a dryer at 80° C. to 85° C. for 50 to 60 minutes to remove about 70% of the water content; removing the second metal wire from the stem; and forming a top end of the stem into a receptacle; and fastening the artificial flower to the flower stem by coating the first metal wire of the artificial flower with a bonding agent and inserting the coated metal wire into the receptacle of said stem.

2. The method of claim 1 wherein said aromatic solution contains by volume:

Sodium α-methyl-α alkylester sulfate: 1.6% to 2.1%

Sodium alkyl aryl sulfate: 2% to 2.3%

Lanolin: 1.1% to 1.75%

Essence: 0.8%

Glycerin: 1.7% to 2.8% and

Water: 90.25% to 93.3%,

3. The method of claim 1 wherein said form setting solution contains by volume:

Polyvinyl acetate: 3% to 6%

Acetic acid: 5% to 12% and

Water: 82% to 92%.

* * * * *